US005289751A

United States Patent [19]

Light

[11] Patent Number: 5,289,751

[45] Date of Patent: Mar. 1, 1994

[54] HUMIDIFIER FOR WOODEN MUSICAL INSTRUMENTS

[76] Inventor: Herbert M. Light, 200 Philellena Rd., Cherry Hill, N.J. 08034

[21] Appl. No.: 825,942

[22] Filed: Jan. 27, 1992

[51] Int. Cl.[5] ..... G10D 1/02

[52] U.S. Cl. ..... 84/275; 84/453; 239/51.5; 239/57

[58] Field of Search ..... 84/275, 453; 239/51.5, 239/57

[56] References Cited

U.S. PATENT DOCUMENTS

| | | | |
|---|---|---|---|
| 1,306,953 | 6/1919 | Fisher . | |
| 1,367,580 | 2/1921 | Ashley | 84/275 |
| 1,802,250 | 4/1931 | Gruppe | 239/51.5 |
| 1,841,398 | 1/1932 | Bergh | 239/51.5 |
| 2,418,878 | 4/1947 | Harkins | 299/24 |
| 2,430,717 | 11/1947 | Hull | 84/1.16 |
| 2,435,096 | 1/1948 | Peterson | 299/24 |
| 2,974,556 | 3/1961 | Fawick | 84/280 |
| 3,128,664 | 4/1964 | Bango | 84/329 |
| 3,302,507 | 2/1967 | Fender | 84/267 |
| 3,407,700 | 10/1968 | Hollander | 84/453 |
| 3,523,479 | 8/1970 | Ludwig | 84/274 |
| 3,719,033 | 3/1973 | Den Boer | 55/387 |
| 3,721,152 | 3/1973 | Von Meyer | 84/453 |
| 3,935,782 | 2/1976 | O'Brien | 84/1.16 |
| 4,144,794 | 3/1979 | Silverman et al. | 84/327 |
| 4,428,892 | 1/1984 | Berliner | 239/51.5 X |
| 4,572,051 | 2/1986 | Laskin | 84/453 |
| 4,649,793 | 3/1987 | Blackshear et al. | 84/453 |

*Primary Examiner*—Michael L. Gellner
*Assistant Examiner*—P. Stanzione
*Attorney, Agent, or Firm*—Volpe and Koenig

[57] ABSTRACT

A humidifier for a wooden stringed instrument. The humidifier comprises a stiff, vapor-permeable tubular member having a cap attached to one end thereof. The humidifier is supported in a hole in the side wall of the stringed instrument, the stiffness of the tubular member allows the humidifier to be cantilevered within the sound box so that the tubular member does not contact the interior of the sound box. In a preferred embodiment, the humidifier is mounted in a hole extending through the string anchor insert of the instrument.

18 Claims, 5 Drawing Sheets

HUMIDIFIER FOR WOODEN MUSICAL INSTRUMENTS

TECHNICAL FIELD

This invention relates generally to a humidifier for wooden musical instruments; more particularly, it relates to a stiff humidifier that is supported in the interior of the sound box of a stringed instrument. The installed humidifier is constructed so that it does not contact an interior surface of the sound box.

BACKGROUND ART

Musicians who play wooden stringed instruments have long realized the need to maintain a sufficiently moist atmosphere within the sound box both while the instrument is stored in its case and while the instrument is being played. U.S. Pat. Nos. 3,407,700—Hollander and 3,721,152—Von Meyer both relate to humidifiers that can be placed in the sound box of a wooden stringed instrument either when it is stored in its case or when it is being played. The Hollander patent discloses a humidifier, in the form of a flexible tubular snake having a water absorbent core, that is placed into the interior of a violin sound box. The humidifier is fed through the f-hole of the violin and a button, having a diameter that is greater than the width of the f-hole, at the end of the humidifier is intended to prevent the humidifier from falling completely into the interior of the violin sound box. The tubular snake is perforated along its length to allow the moisture to evaporate into the interior of the violin sound box. One disadvantage of the humidifier of Hollander is that since it is long, flexible, and limp, the violinist can not hold it at one end and feed it through the f-hole in one continuous motion but rather the violinist must feed it through the f-hole a few inches at a time. Also, when the humidifier is fully inserted into the interior of the sound box, a portion of the flexible humidifier contacts the interior surface of the sound box which blocks some of the moisture evaporation apertures and may excessively wet the contacted interior areas. Another disadvantage is that the retaining button of the humidifier is visible when the instrument is played. This humidifier tends to be loose and rattles during use of violin and tends to work free and out of the f-hole.

The Von Meyer patent discloses a humidifier that is inserted through the sound hole of a guitar and is held in position by a clip that attaches to the top surface of the guitar at the sound hole. The humidifier of Von Meyer is dimensionally limited to one that can fit through a hole in the top plate of the instrument.

U.S. Pat. No. 4,649,793—Blackshear et al discloses a humidifier that extends into the interior of the sound box of a guitar during storage and which seals the sound hole. U.S. Pat. No. 4,572,051—Laskin discloses a humidifier that is supported by the strings of a wooden instrument during storage. Laskin also discloses a humidifier that uses a water impermeable container wall but with vapor permeable material. U.S. Pat. No. 2,974,556—Fawick discloses an adjustable end-rest foot assembly that is partially retractable into the interior of a violoncello or a bass viol. U.S. Pat. No. 3,935,782—O'Brien discloses an electrical connector for an electric guitar or violin wherein the connector also can serve as the string button of a guitar or the end button of a violin.

It is an object of this invention to provide a humidifier for a wooden, string instrument that can be inserted into the sound box of the instrument in one simple motion.

Another object of this invention is to provide a humidifier that can be located within the sound box of a wooden stringed instrument but has a dimension that is longer than the dimension of any natural opening of the instrument yet does not contact the interior surface of the sound box when installed.

And yet another object of this invention is to provide a humidifier for a wooden, stringed instrument that is supported through a hole in the side wall of the sound box of the instrument.

DISCLOSURE OF THE INVENTION

In accordance with this invention, there is provided a humidifier for a wooden stringed instrument that is mounted in a hole in the side wall of the sound box. The humidifier comprises a stiff, perforated, tubular member filled with a water absorbing material and having a cap attached to one end thereof. The tubular member is inserted into the interior of the stringed instrument through a hole in the sidewall which supports the cap of the humidifier. The stiffness of the tubular member allows it to be cantilevered in the sound box so that it does not contact either the top plate or the bottom plate of the instrument. In a preferred embodiment, the humidifier is supported in a hole through the string anchor support of the instrument (e.g. the tail of a violin.)

BRIEF DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

BEST MODE FOR CARRYING OUT THE INVENTION

Figure 2:
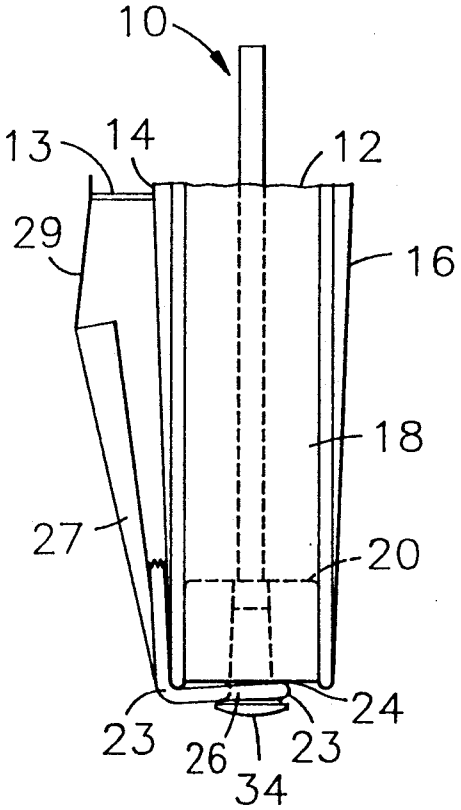
FIG. 2 is a side elevation of the violin and humidifier of FIG. 1.
Figure 1:
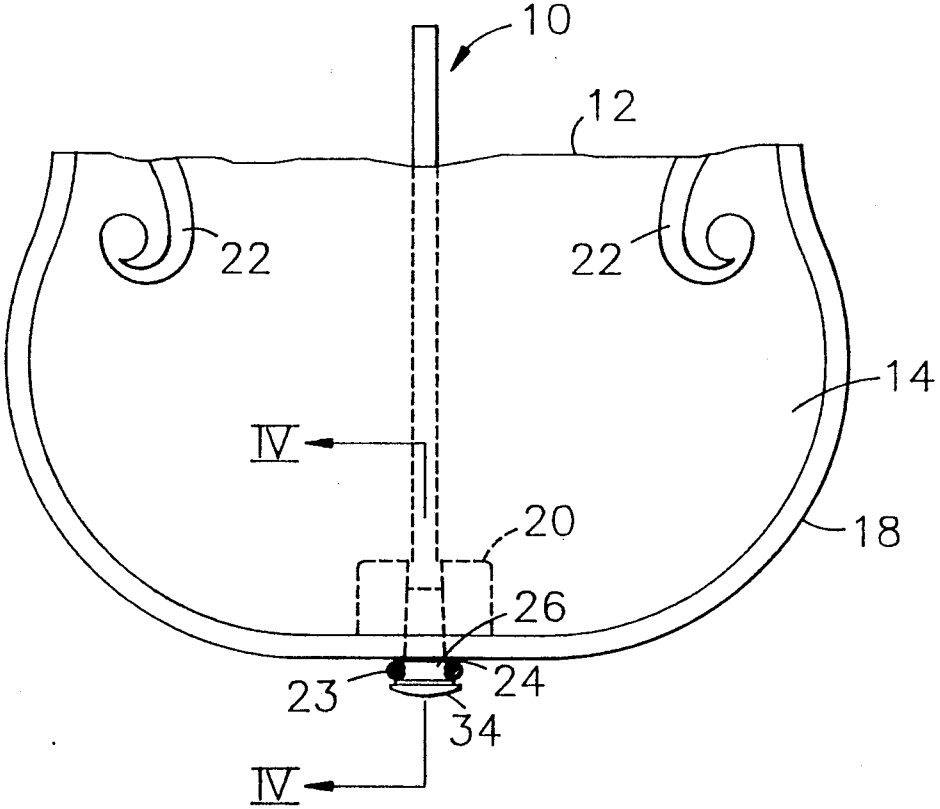
FIG. 1 is a partial plan view of a violin incorporating the humidifier of the present invention.

Referring now to FIGS. 1 and 2, there is shown a partial view of a violin sound box 12 in which is mounted the humidifier 10 of this invention. The sound box 12 has a top plate 14 and a bottom plate 16 separated by a side wall 18. The typical violin sound box 12 also has two sound holes 22, called f-holes, located in the top plate 14. Located in the end side wall 18, a string anchor insert 24 (called the "end nut") which has an annular string retaining groove 26 for anchoring, via the tail piece 27, one end of the violin strings 29 secured to the end of the tail piece by a cord loop 23.

Figure 3:
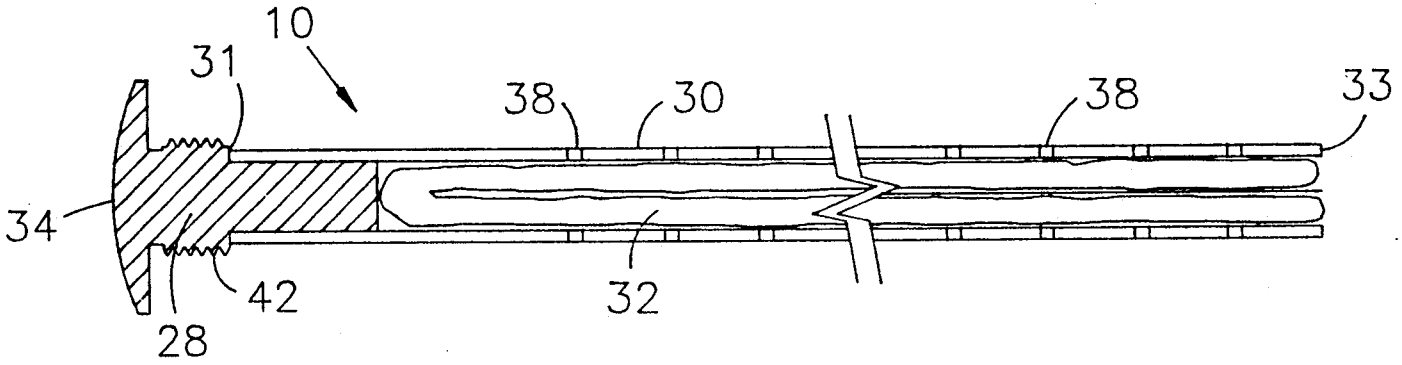
FIG. 3 is a sectional view of a part of the humidifier of FIG. 1.

Referring to FIG. 3, there is shown a basic humidifier 10 comprising a stiff, vapor permeable, tubular member 30 having a cap 28 inserted into one end 31 of the tubular member 30. The tubular member 30 is made to be relatively stiff, and, for example, can be constructed out of thin plastic. A plurality of holes 38, having a diameter of about 0.10 inch, in the wall of the tubular member 30 renders the tubular member 30 vapor permeable. Because of the perforation holes 38, the tubular member 30 is not capable of holding water by itself, therefore the interior of the tubular member 30 is filled with a water absorbing material 32, such as cellulose, which holds water and prevents water droplets from flowing out of the tubular member 30 through the perforation holes 38. Since the water absorbing material 32 holds water in the tubular member 30, the end 33 of the tubular member does not have to be closed. In addition the tube at that end is left without apertures for approximately an inch to prevent dripping when the instrument is tilted. Similarly, the other end of the tube 30 is left without apertures. However, to avoid water leakage from the tube it has been found desirable to use a rubber plug to close the outer end 33 of the tube.

Figure 4:
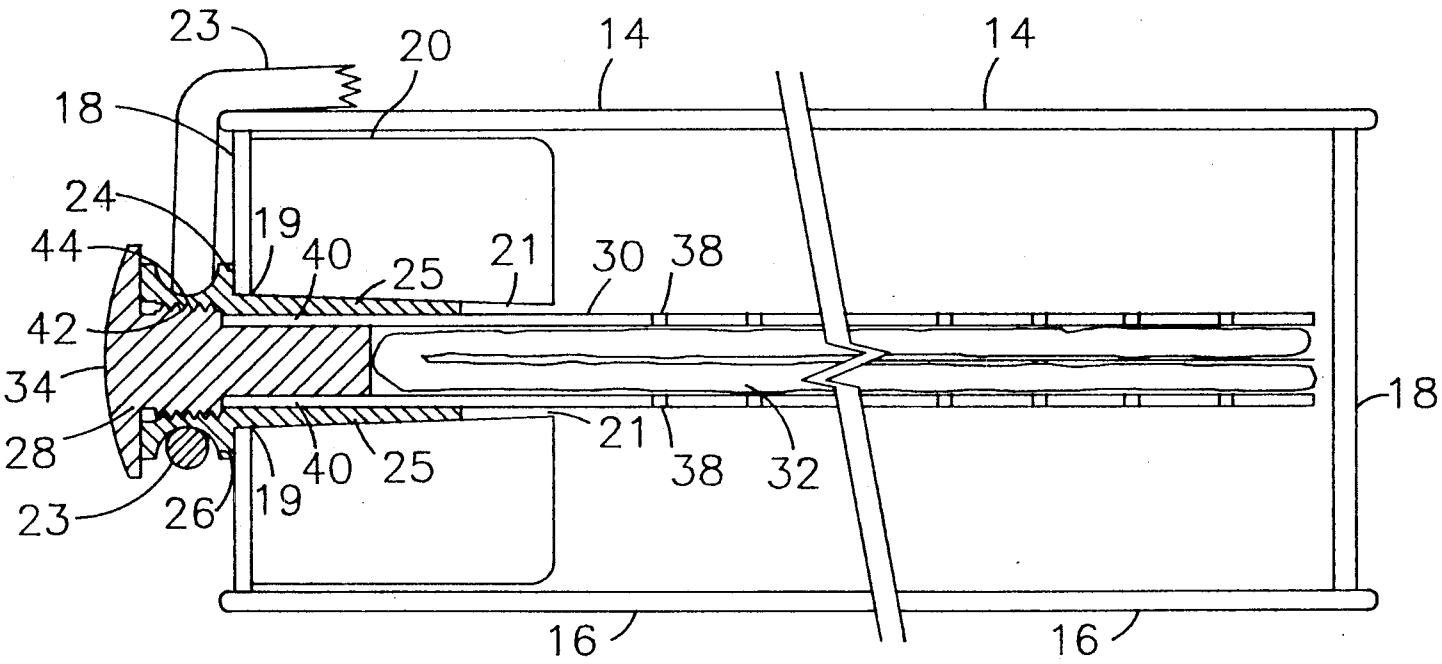
FIG. 4 is a sectional view taken through line IV—IV of FIG. 1.

Referring now to FIG. 4, there is shown an embodiment of the humidifier 10 that is inserted into the interior of the sound box 12 through the hole 19 in side wall 18 through which the string anchor insert 24 of an ordinary violin is inserted and supported. The string anchor insert or end nut replacement 24 has a tapered side wall 25 so that it produces a tight friction fit when inserted into the hole 19 in the end side wall 18 and the tapered hole 21 in reinforcing end block 20 respectively. The string anchor insert 24 has an annular string restraining groove 26 about which one end of the cord loop 23 is inserted; the other end of loop 23 is connected to one end of the tail piece 27, and the latter's other end anchors the strings 29 that pass over and are tensioned by bridge 13. The string anchor insert 24 has a circular recess 40 extending along and around its axis and along which recess 40 the circular tube 30 extends and passes when it is inserted into or withdrawn from the interior of the violin sound box 12. The cap 28 of the humidifier 10 also fits into the longitudinal hole 40 in the string anchor insert 24 and is retained therein either by a friction fit or, as shown in FIG. 4, by means of threads 44 on the humidifier cap 28 and threads 42 in the interior wall of the string anchor insert 24. The cap 28 terminates in a knob 34 which the user can grasp and turn in one direction as the humidifier tube 30 is inserted into or in the opposite direction as withdrawn from the interior of the sound box 12 of the instrument.

When the humidifier tube 30 is installed in the interior of the sound box 12, the stiffness of the tubular section 30 prevents it from contacting the interior surface of either the top plate 14 or the bottom plate 16 of the sound box 12. Thus, by way of example, if the distance between the top plate 14 and the bottom plate 16 of the instrument is 1.40 inches, and the tubular member 30 has a length of 9.0 inches and an outer diameter of 0.15 inches, the end 33 of the tubular member 30 can deflect about 0.60 inches without contacting the top or bottom plates 14, 16 of the violin. The relative stiffness of the tubular member 30 also allows the humidifier 10 to be easily withdrawn from or inserted into the interior of the sound box 12 in a single motion.

In operation, the humidifier 10 is easily charged by inserting the tubular member 30 into a container of water and allowing the water to pass through the holes 38 and the open end 33 and be absorbed by the material 32. When the water is stored in tube 30, the tube can be inserted through passageway 40, holding on to knob 34 and turning to link threads 42 and 44. Again via knob 34, these threads are turned and unlinked to remove tube 30 for refilling.

Figure 5:
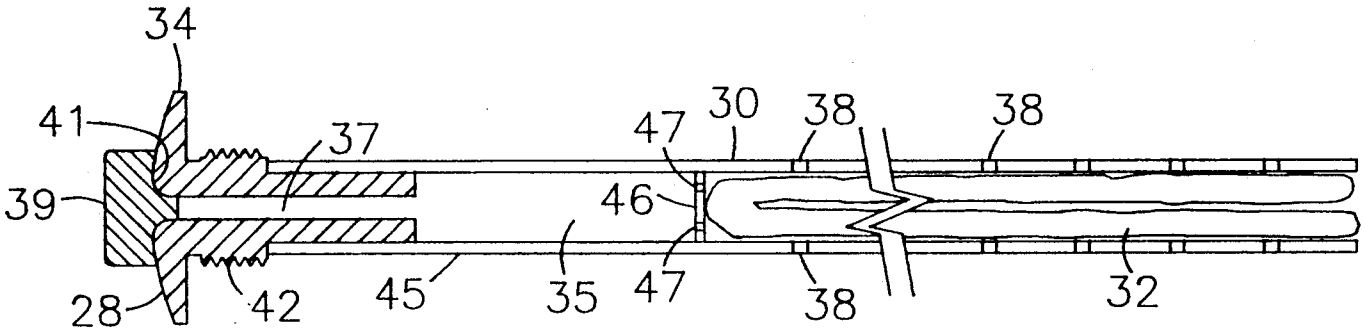
FIG. 5 is a sectional view of an alternate embodiment of the humidifier of the present invention.

FIG. 5 shows another embodiment of the humidifier of FIG. 3 wherein the end 45 of the tubular member 30 adjacent the cap 28 is not perforated and a disc 46 separating the non-perforated end 45 from the perforated section of the tubular member 30 forms a water reservoir 35 adjacent the cap 28. Small apertures 47 having a diameter of 1/32 to 1/64 inch in the disc 46 allows water to controllably pass into the water absorbent material containing section of the humidifies thereby recharging the water aborbent material 32. A water filling passage 37 extends through the cap 28 so that the reservoir can be filled through the opening 41 in The reservoir 35 is filled with water which is injected, e.g. from a squeeze bottle, through passage 37. A soft plug 39 prevents the water from flowing out of the reservoir through the opening 41 in the cap 28.

Figure 6:
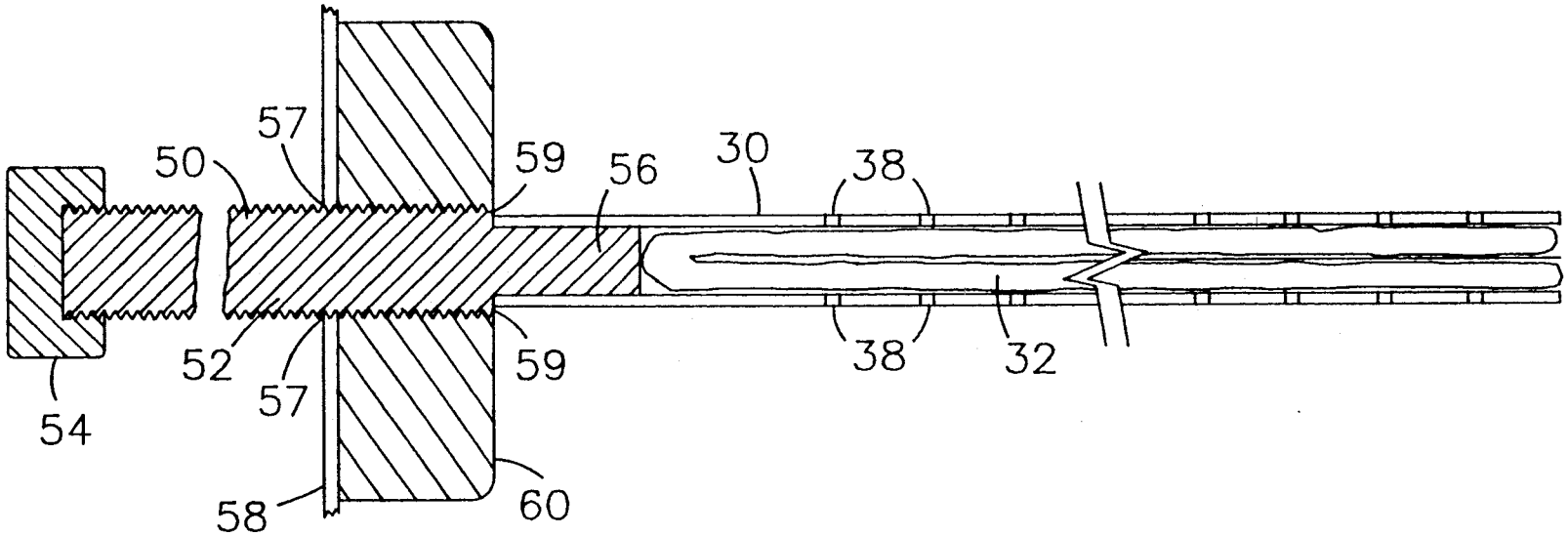
FIG. 6 is a partial sectional view showing the humidifier of this invention attached to an end pin installed in a wooden stringed instrument, such as a cello or bass violin, and on which the instrument rests.

FIG. 6 illustrates another embodiment of the humidifier 10 in which the humidifier forms part of an end rest assembly 50 of a large musical stringed instrument such as a cello or a bass viol. The end pin or rest assembly 50 has a shaft 52, one end of which terminates in a floor rest 54, which can be made out of rubber, and the other end which terminates in a humidifier cap portion 56. The tubular container section 30 that holds the water absorbent material 32 is attached to the cap portion 56 of the end rest assembly 50. The combination of the end rest assembly 50 and the humidifier is inserted into and supported within a hole 57 in the cello's end side wall 58 and hole 59 in end block 60 of the instrument. The reserving container 30 is filled with water by first removing the end rest assembly from the end wall hole 57 and the end block hole 59, filling the container, and reassembling the end rest assembly.

Thus, this invention provides a new and improved humidifier for a wooden string instrument. Applicant has disclosed various forms and modification of the invention and others will be apparent to those skilled in the art from the concepts set forth above and in the following claims. Applicant does not intend to be limited in the scope of his invention except as set forth in the claims themselves.

I claim:

1. An improved humidifier of the type that is mounted through an aperture into a wooden musical instrument's sound box, the sound box having a side wall aperture used for a string anchor insert, the improvement comprising:

a self-supporting, vapor-permeable, liquid retaining tubular member; and an attachment means for supporting the tubular member within the sound box from said side wall aperture without the tubular member contacting the sound box.

2. The humidifier of claim 1, further comprising a liquid-absorbent material situated within the tubular member for retaining liquid.

3. The humidifier of claim 1, wherein the tubular member is perforated.

4. The humidifier of claim 1, wherein the tubular member is cantilevered from the attachment means.

5. The humidifier of claim 4, wherein a portion of the tubular member, adjacent the cantilevered end, is not liquid-permeable, and wherein the attachment means contains a liquid filling passageway into the tubular member, the humidifier further comprising a perforated barrier, separating the non-liquid-permeable section of the tubular member from the vapor-permeable portion of the tubular member, thereby forming a liquid reservoir at the cantilevered end of the tubular member, and a plug inserted into the attachment means for sealing the humidifier after it is filled, the barrier perforations being sized to control the rate of flow of liquid into the vapor-permeable section of the tubular member.

6. The humidifier of claim 5, further comprising a liquid-absorbent material situated within the vapor-permeable portion of the tubular member of retaining liquid.

7. The humidifier of claim 6, wherein the vapor-permeable portion of the tubular member is perforated.

8. In combination a wooden musical instrument and a humidifer, the instrument having a sound box including a side wall, an aperture in the side wall used for a string anchor insert, a top plate, and a bottom plate, the humidifier comprising:

a self-supporting, vapor-permeable, liquid-retaining tubular member; and an attachment means for supporting the tubular member within the sound box from said side wall aperture without the tubular member contacting the sound box.

9. The combination of claim 8, further comprising a liquid-absorbent material situated within the tubular member for retaining liquid.

10. The combination of claim 8, wherein the tubular member is perforated.

11. The combination of claim 8, wherein the tubular member is cantilevered from the attachment means.

12. The combination of claim 11, wherein a portion of the tubular member, adjacent the cantilevered end, is not liquid-permeable, and wherein the attachment means contains a liquid filling passageway into the tubular member, the humidifier further comprising a perforated barrier, separating the non-liquid-permeable section of the tubular member from the vapor-permeable portion of the tubular member, thereby forming a liquid reservoir at the cantilevered end of the tubular member, and a plug inserted into the attachment means for sealing the humidifier after it is filled, the barrier perforations being sized to control the rate of flow of liquid into the vapor permeable section of the tubular member.

13. The combination of claim 12, further comprising a liquid-absorbent material situated within the vapor-permeable portion of the tubular member for retaining liquid.

14. The combination of claim 13, wherein the vapor-permeable section of the tubular member is perforated.

15. The combination of claim 8, wherein the instrument is a violin having a string anchor insert and wherein the aperture also extends through the string anchor insert.

16. The combination of claim 15, wherein the string anchor insert is threaded and the attachment means has mating threads for threadingly engaging the anchor inserts.

17. The combination of claim 15, wherein the attachment means is friction-fitted to the string anchor insert.

18. In combination a wooden musical instrument and a humidifier, the instrument having a sound box including a side wall, an aperture in the side wall, a top plate, a bottom plate and an end rest assembly, including an end block and a shaft that threadingly engages the end block, the humidifier being mounted on one end of the assembly extending into the sound box the humidifier comprising:

a self-supporting, vapor permeable, liquid-retaining tubular member;

an attachment means for supporting the tubular member within the sound box without the tubular member for retaining liquid; and a cap portion attached to the shaft for retaining liquid.

* * * * *

UNITED STATES PATENT AND TRADEMARK OFFICE

CERTIFICATE OF CORRECTION

PATENT NO. : 5,289,751

DATED : March 1, 1994

INVENTOR(S) : Herbert M. Light

It is certified that error appears in the above-identified patent and that said Letters Patent is hereby corrected as shown below:

At column 2, line 68, delete "vapor permeable" and insert therefor --vapor-permeable--.

At column 4, line 13, delete "humidifies" and insert therefor --humidifier--.

At column 4, line 16, after the word "in", insert --cap 28 and passage 37--.

In claim 6, at column 5, line 12, delete "member of" and insert therefor --member for--.

In claim 18, at column 6, line 36, delete "for retaining liquid" and insert therefor --contacting the sound box--.

Signed and Sealed this

Twelfth Day of July, 1994

*Attest:*

Bruce Lehman

BRUCE LEHMAN

*Attesting Officer*

*Commissioner of Patents and Trademarks*